US006896292B2

(12) United States Patent
Cuerrier

(10) Patent No.: US 6,896,292 B2
(45) Date of Patent: May 24, 2005

(54) ANTISKID DEVICE FOR INLINE SKATES

(76) Inventor: Gilles Cuerrier, 2670, Roland Therrien, Longueuil, Quebec (CA), H1X 1M4

( * ) Notice: Subject to any disclaimer, the term of this patent is extended or adjusted under 35 U.S.C. 154(b) by 0 days.

(21) Appl. No.: 10/679,527

(22) Filed: Oct. 6, 2003

(65) Prior Publication Data

US 2004/0124627 A1 Jul. 1, 2004

Related U.S. Application Data

(60) Provisional application No. 60/416,464, filed on Oct. 7, 2002.

(51) Int. Cl.[7] ..... A63C 3/12; A63C 11/00; A43B 5/00

(52) U.S. Cl. ..... 280/825; 280/811; 36/132; D21/764

(58) Field of Search ..... 280/811, 825, 280/809, 11.221, 11.19; 36/132, 135, 136; D21/764, 772

(56) References Cited

U.S. PATENT DOCUMENTS

| | | | | | |
|---|---|---|---|---|---|
| 3,861,967 | A | | 1/1975 | Dolce | |
| 4,355,474 | A | * | 10/1982 | Grim | 36/132 |
| 4,364,187 | A | | 12/1982 | Melendez | |
| 4,413,842 | A | * | 11/1983 | Loredo | 280/825 |
| 5,183,292 | A | | 2/1993 | Ragin | |
| 5,236,224 | A | | 8/1993 | Anderson | |
| 5,290,065 | A | | 3/1994 | Kassal | |
| 5,303,955 | A | * | 4/1994 | Zurnamer | 280/825 |
| 5,445,415 | A | | 8/1995 | Campbell | |
| 5,503,433 | A | * | 4/1996 | Lachapelle | 280/825 |
| 5,513,881 | A | * | 5/1996 | DiMeglio et al. | 280/825 |
| 5,522,621 | A | | 6/1996 | Schneider | |
| 5,573,275 | A | | 11/1996 | Smith | |
| 5,580,094 | A | | 12/1996 | Ruehlman | |
| 5,697,643 | A | | 12/1997 | Marasco | |
| 5,765,870 | A | | 6/1998 | Riley | |
| 5,833,270 | A | * | 11/1998 | Hubshman | 280/825 |
| 5,836,425 | A | * | 11/1998 | Ahlstrom | 188/4 R |
| 5,848,808 | A | | 12/1998 | Fenton | |
| 5,924,733 | A | | 7/1999 | Palleschi | |
| 5,951,049 | A | | 9/1999 | Calverley | |
| 6,079,747 | A | | 6/2000 | Winsor | |
| 6,193,277 | B1 | | 2/2001 | Marasco | |
| 6,481,724 | B1 | * | 11/2002 | Whipp | 280/7.13 |

* cited by examiner

*Primary Examiner*—Christopher P. Ellis
*Assistant Examiner*—Gerald B Klebe

(57) ABSTRACT

The present invention provides an antiskid device which covers inline skate wheels and which can be folded onto itself so as to become half as long. In this way, it is much easier to conceal inside a pocket or a pouch.

4 Claims, 6 Drawing Sheets

ANTISKID DEVICE FOR INLINE SKATES

This application claims priority based on provisional application No. 60/416,464 filed Oct. 7, 2002 for claim 1.

BACKGROUND OF THE INVENTION

1. Field of the Invention

This invention relates to inline skates in general but more specifically to a removable antiskid device that covers the wheels of inline skates.

2. Description of the Prior Art

Ever since inline skates became popular and, to a certain extent, from the time of the older roller skates, the problem of using those same skates off track has been a problem. As is well known, aficionados of inline skating use them to go to work, some messenger services even use inline skaters to deliver parcels. When comes time to climb stairs or move around inside office buildings, use public transit or roll down steep hills, rolling wheels can be a hazard to both the users and surrounding people. Several inventors have developed devices to cover the wheels of all types of roller skates. As usual, some inventors like things heavy, bulky and impractical with complex attachment means while others are a bit more practical and provide for rather uncumbersome and easy to use skate wheel covers.

Despite the numerous variations found in the prior art, the problem remains that users with long feet require long skate wheel covers which are cumbersome to carry when not in use. Therefore, there is a need for an improved skate wheel cover device.

SUMMARY OF THE INVENTION

The present invention provides an antiskid device which covers inline skate wheels and which can be folded onto itself so as to become half as long. In this way, it is much easier to conceal inside a pocket or a pouch.

It is also an object of this invention to provide for an antiskid device for inline skates which is easy to install and uninstall.

It is another object of this invention to provide for an antiskid device for inline skates which is held more securely onto the wheels.

It is yet another object of this invention to provide for an antiskid device for inline skates which can adapt to various wheel diameters as well as wheel spacing.

The foregoing and other objects, features, and advantages of this invention will become more readily apparent from the following detailed description of a preferred embodiment with reference to the accompanying drawings, wherein the preferred embodiment of the invention is shown and described, by way of examples. As will be realized, the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE PREFERRED EMBODIMENT

Figure 1:
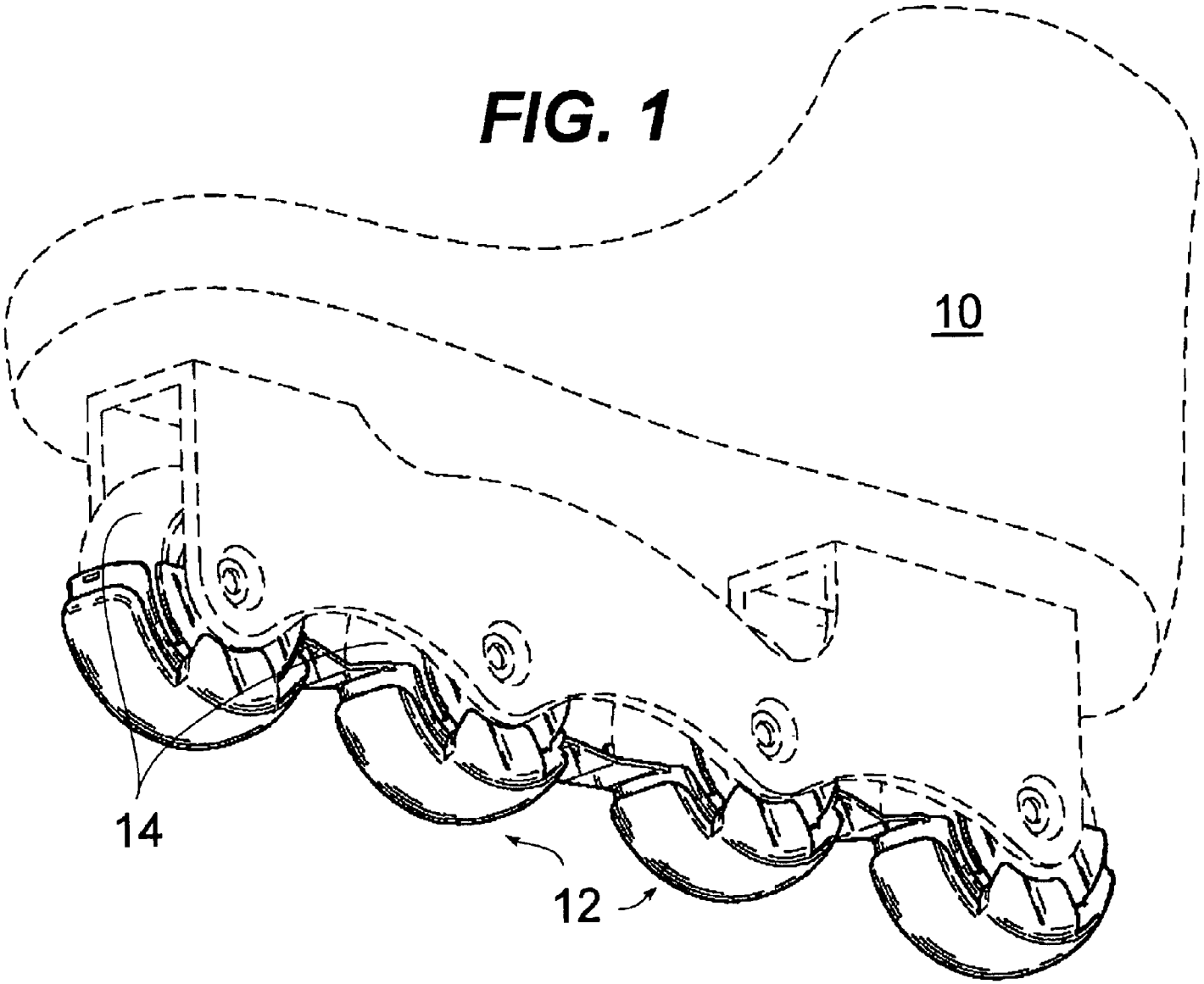

FIG. 1 orthogonal view of the antiskid device deployed and in context.

Figure 2:
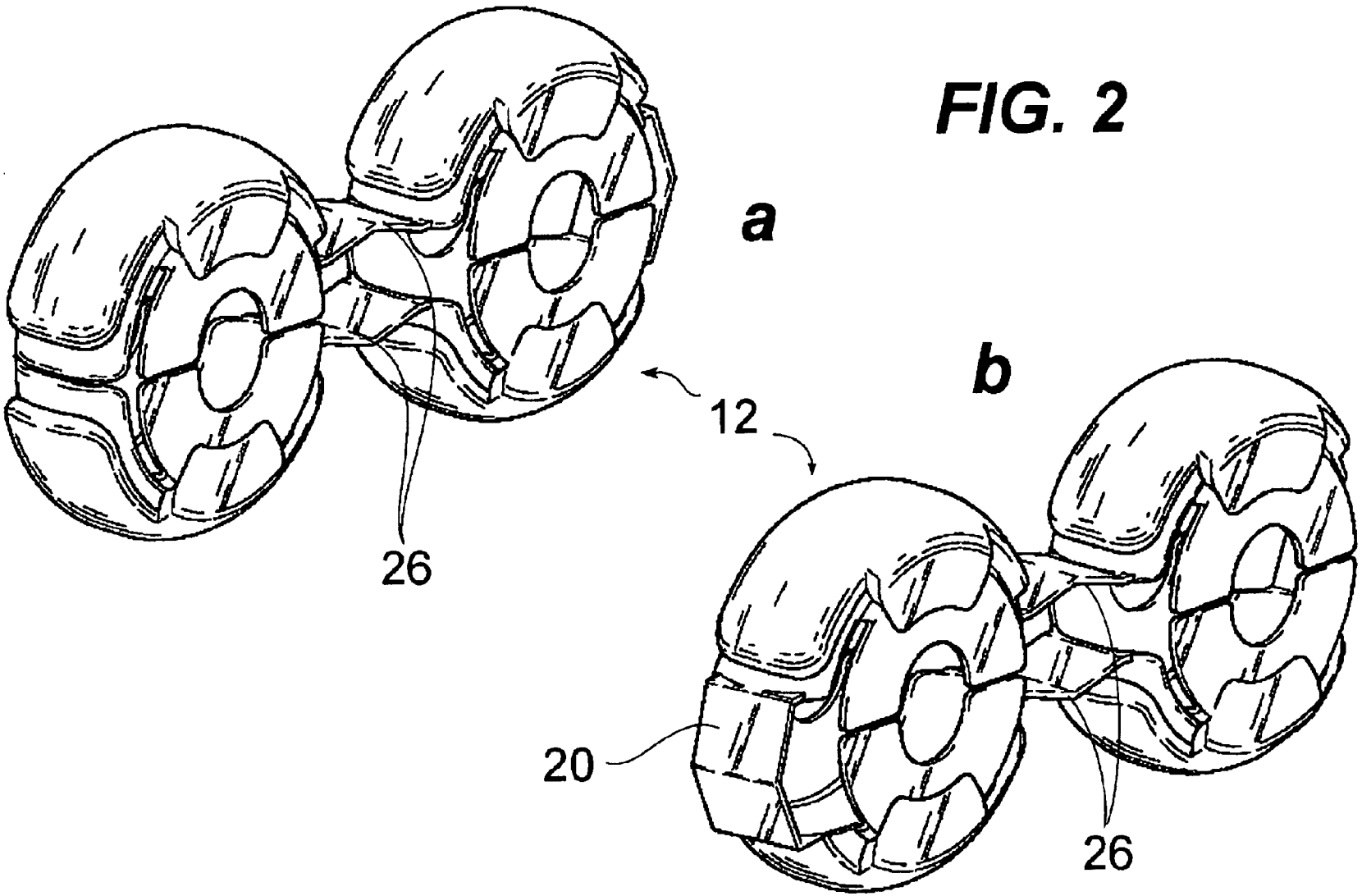

FIG. 2*ab* orthogonal views, front and back respectively, of folded antiskid device.

Figure 3:
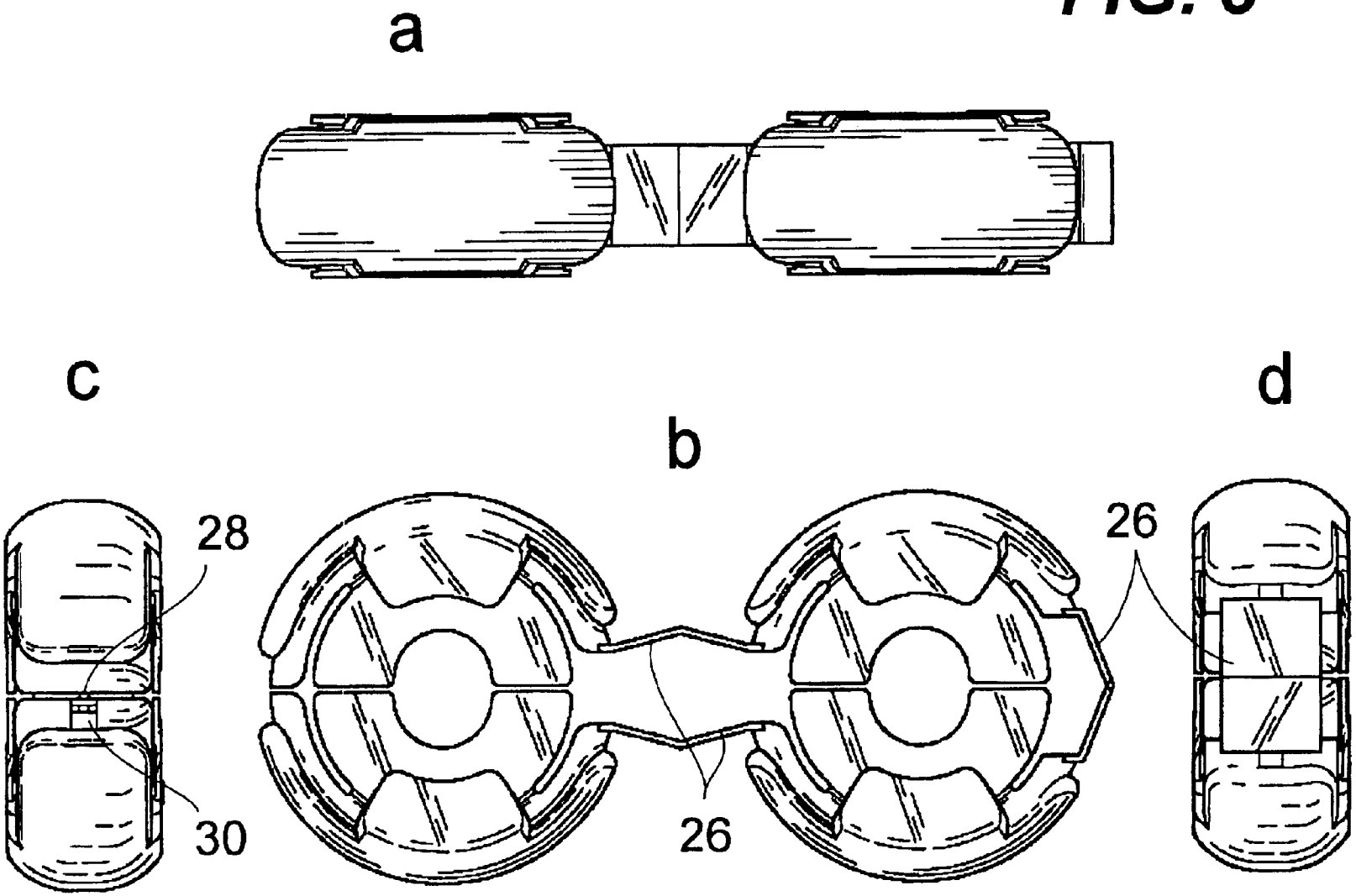

FIG. 3*abcd* bottom, side, front, and back views respectively of the folded antiskid device.

Figure 4:
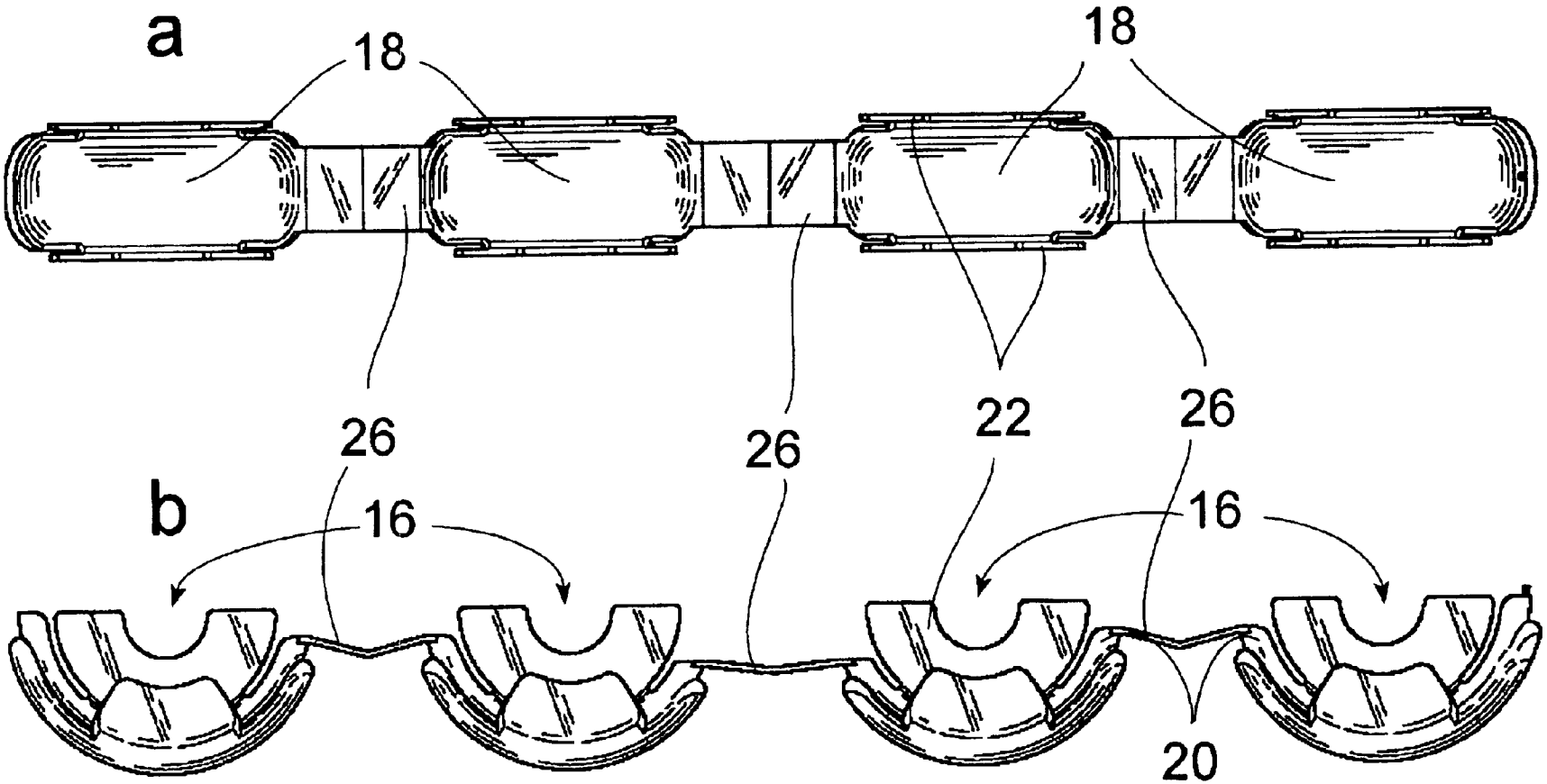

FIG. 4*ab* bottom and side deployed views of the antiskid device.

Figure 5:
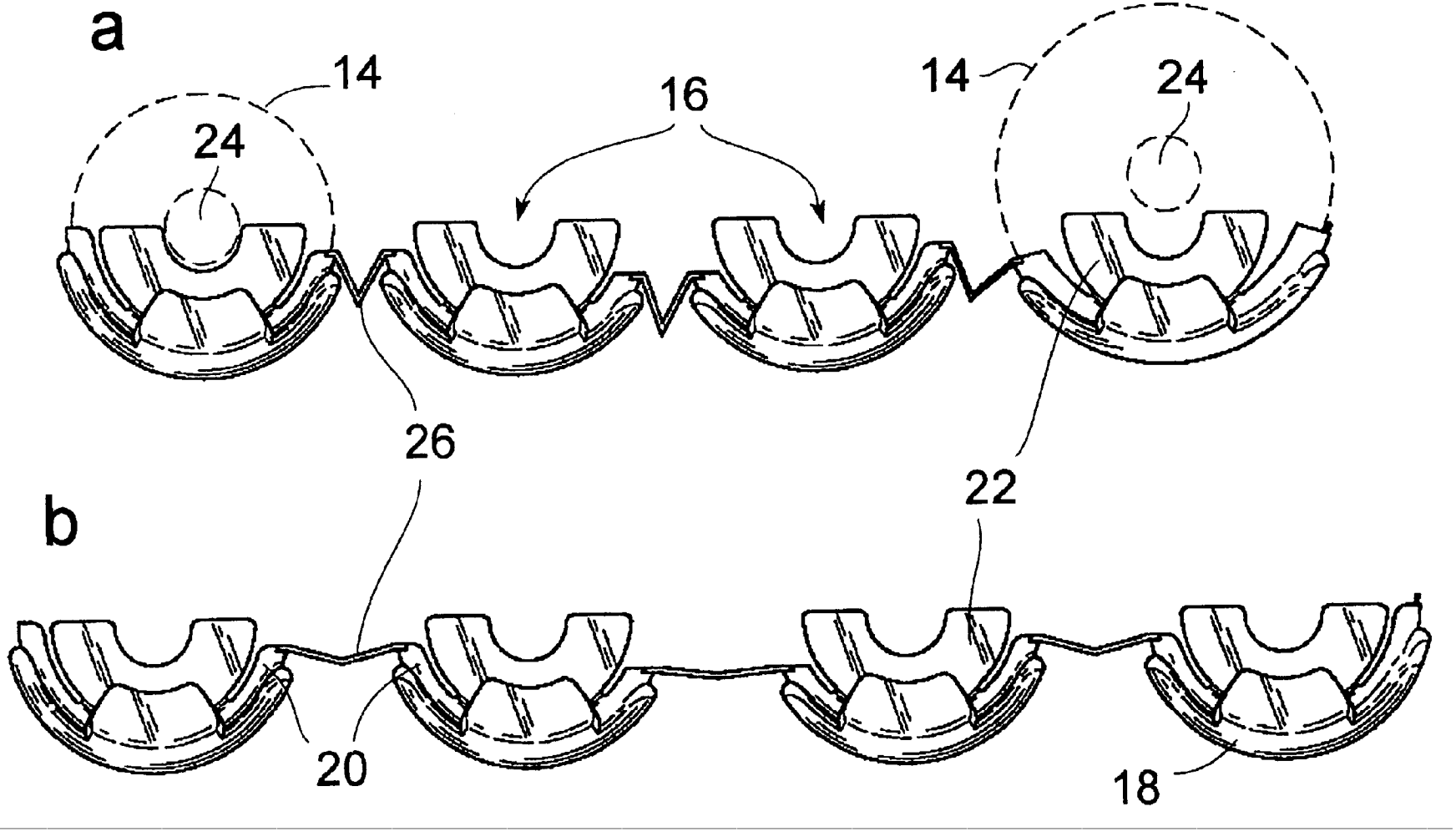

FIG. 5*ab* side views showing variable wheel diameter adaptability and variable wheel distance adaptability, respectively, of the antiskid device.

Figure 6:
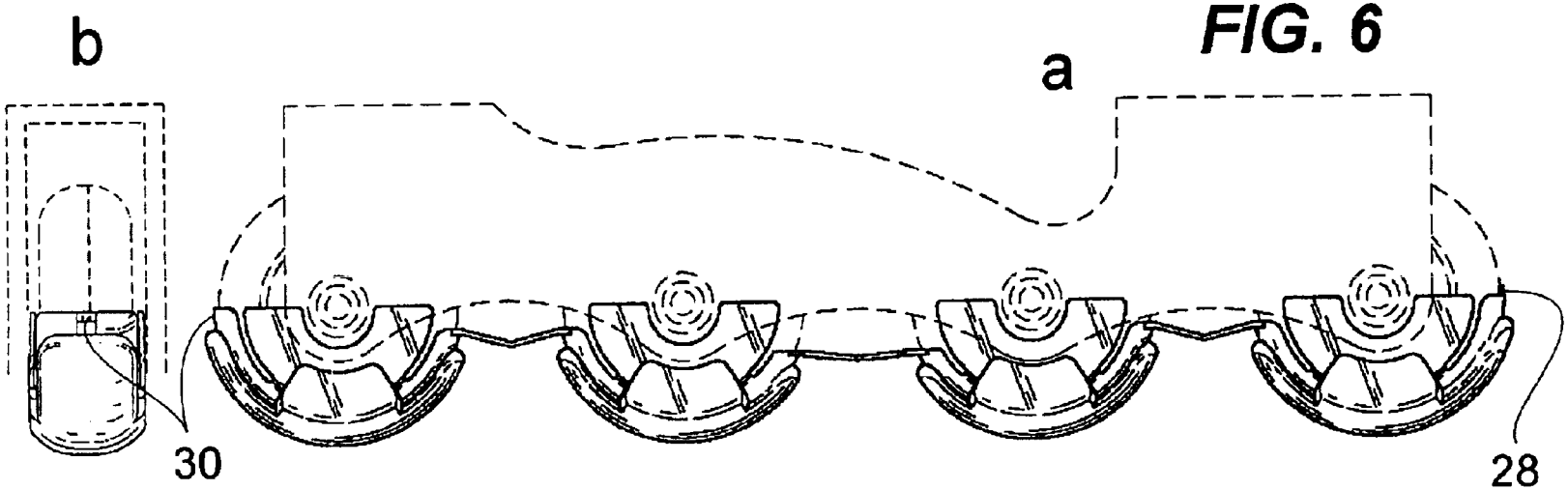

FIG. 6*ab* side and front views respectively of the antiskid device in context.

Figure 7:
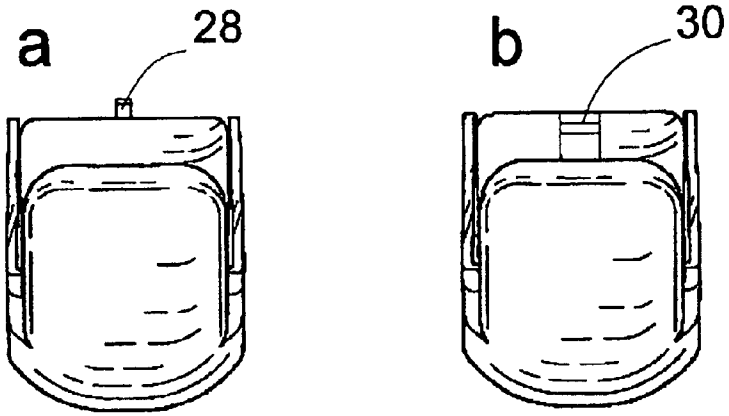

FIG. 7*ab* front and back views respectively of the deployed antiskid device.

DETAILED DESCRIPTION OF THE PREFERRED EMBODIMENTS

An inline skate (10) has an antiskid device (12) installed over its wheels (14) as per FIG. 1. The antiskid device (12) consists of a plurality of wheel receptacles (16) as per FIGS. 4–5. The receptacle only cover the bottom half of the wheels (14) and consist of a high friction (hence antiskid) device (18) joined to and covering the exterior surface of a pliable and resillient shall (20). Side panels (22) are configured and sized to frictionally engage the side of the wheels (14) up to or near the axle (24) so as to securely engage the antiskid device (12) to the wheels (14) and also give a user a strong grasp to facilitate insertion and removal onto the wheels (14).

Each wheel receptacle (16) is linked to the next adjacent receptacle by way of a hinge (26). The hinge (26) has two main functions: The first being to fold each grouping of receptacles (16) by rotating them together around the hinge (26) and mating them in clamshell fashion to procure a more compact size as per FIGS. 2–3 so as to facilitate carrying of the antiskid device (12) when not in use. The second function of the hinge (26) is to vary the distance between each receptacle (16) so as to accommodate to various spacings between inline skate wheels (14) such as in FIG. 5*a*.

Also, the pliable and resillient shell (20) allows for different wheel diameters to fit as seen in FIG. 5*a*. Indeed, there are different wheel (14) diameters for different skate (10) models and sometimes, even on a single pair of skates (10).

Inline skates (10) don't always have 4 wheels, as per the illustrations. In fact, the number of wheels can vary from 3 to 6. A 4 receptacle antiskid device (12) could fit a 3 wheel skate (10) by either snipping off one receptable (16) or leaving it there if it doesn't bother. A 6 receptacle (16) antiskid device (12) could, likewise, serve for a 5 or 6 wheel (14) inline skate (10).

To keep the antiskid device (12) in a closed clamshell fashion, a small clip (28) clips into a fleece (30). Both the clip (28) and the recess (30) are situated at opposite extremities of the antiskid device (12) as per FIGS. 6–7.

What is claimed is:

1. An antiskid device for inline skates comprising:

a plurality of wheel receptacles to receive inline skate wheels;

said wheel receptacles comprised of a high friction means joined to a pliable and resilient shell;

said wheel receptacles further comprised of side panels extending upwardly therefrom and being configured and sized to frictionally engage the side of said wheels up to or near the axle so as to securely engage over said wheels;

hinges to link each wheel receptacle to the next adjacent wheel receptacle so as to allow clamshell folding of said antiskid device.

2. An antiskid device for inline skates as in claim 1, wherein:

said hinges are used as means to vary spacing between each receptacle.

3. An antiskid device for inline skates as in claim 1, wherein:

said wheel receptacles are pliable and resilient so as to be able to change size so as to allow for different diameters of said wheels to fit inside said receptacles.

4. An antiskid device for inline skates comprising:

a plurality of wheel receptacles to receive inline skate wheels;

said wheel receptacles comprised of a high friction means joined to a pliable and resilient shell;

said wheel receptacles further comprised of side panels extending upwardly therefrom and being configured and sized to frictionally engage the side of said wheels up to or near the axle so as to securely engage over said wheels;

hinges to link each wheel receptacle to the next adjacent wheel receptacle so as to allow clamshell folding of said antiskid device;

said hinges used as means to vary spacing between each receptacle;

said wheal receptacles being pliable and resilient so as to be able to change size so as to allow for different diameters of said wheels to fit inside said receptacles;

a clip clipping into a recess wherein both said clip and said recess being situated at opposite extremities of said plurality of wheel receptacles so as to secure said antiskid device in a clamshell configuration.

* * * * *